United States Patent [19]

Couture et al.

[11] Patent Number: 4,516,117

[45] Date of Patent: May 7, 1985

[54] RANGE CONTROLLER FOR CONTINUOUSLY MONITORING THE POSITION OF THE BOOM OF HEAVY MACHINERY

[76] Inventors: Raymond Couture, 222 Pente du Moulin, Beauceville, County of Beauce, Canada, G0S 1A0; Raynald Couture, Lac Etchemin, County of Bellechasse, Canada, G0R 1S0; Paul Poulin, 816 Principale St., St. Elzéar, County of Beauce, Quebec, Canada, G1V 4K1

[21] Appl. No.: 365,488

[22] Filed: Apr. 5, 1982

[51] Int. Cl.[3] ..... G08B 21/00

[52] U.S. Cl. ..... 340/685; 212/151; 212/153; 212/154; 212/156; 414/701

[58] Field of Search ..... 364/559, 424; 340/685, 340/689; 212/151, 154, 156, 153; 414/699, 700, 701

[56] References Cited

U.S. PATENT DOCUMENTS

| | | | |
|---|---|---|---|
| 3,642,148 | 2/1972 | Durand | 212/156 |
| 3,819,922 | 6/1974 | Horn et al. | 364/559 X |
| 4,037,742 | 7/1977 | Gustafsson | 414/699 X |
| 4,064,997 | 12/1977 | Holland et al. | 212/151 |
| 4,205,308 | 5/1980 | Haley et al. | 364/559 X |
| 4,236,864 | 12/1980 | Couture et al. | 414/699 |

*Primary Examiner*—Jerry W. Myracle

[57] ABSTRACT

A range controller for continuously monitoring the position of the boom of heavy machinery, is disclosed. The range controller comprises position sensors mounted on the boom and on the machinery for continuously detecting the position of the boom with respect to a reference, control switches located in the cabin of the machinery for permitting the operator to set the position limits of the boom, a central control circuit mounted on the machinery and comprising a micro-processor circuit adapted for connection to the sensors and to the control switches and memory devices for registering the position of the boom as well as the position limits set by the operator and for continuously comparing the actual position of the boom with the position limits, indicators located in the cabin of the machinery and responsive to such micro-processor circuit for warning the operator; a blocking system responsive to the micro-processor for blocking the operation of the boom when a position limit is reached; a main relay, for operating the blocking system, and being electrically energized during normal operation of the machine to release the blocking system so that, in the event of a power cut-off, the main relay is released to operate the blocking system; and additional relays for reversing the operation of the boom when the main relay is released so as to ensure safe stopping of the boom.

8 Claims, 11 Drawing Figures

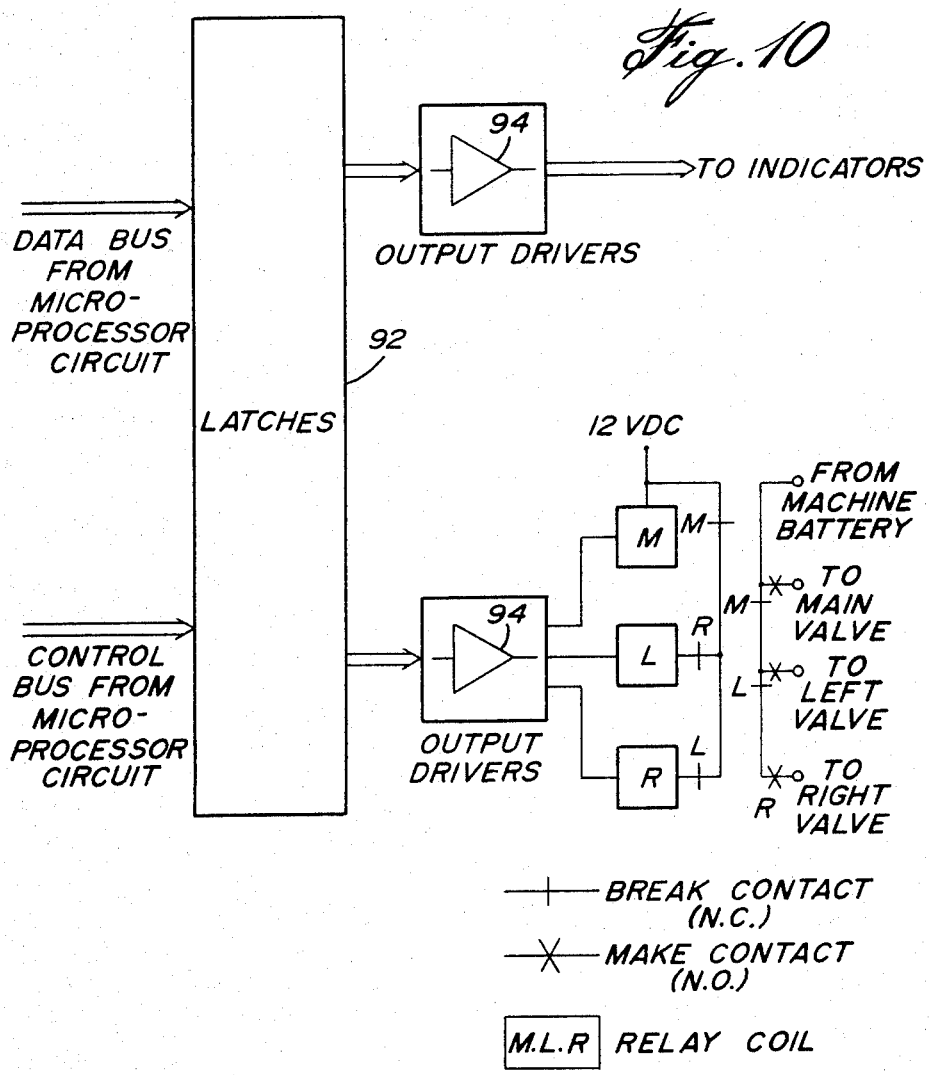
Fig. 10
94
TO INDICATORS
DATA BUS FROM MICRO-PROCESSOR CIRCUIT
OUTPUT DRIVERS
92
LATCHES
12 VDC
FROM MACHINE BATTERY
M
M
TO MAIN VALVE
94
R
L
TO LEFT VALVE
CONTROL BUS FROM MICRO-PROCESSOR CIRCUIT
OUTPUT DRIVERS
L
R
TO RIGHT VALVE
BREAK CONTACT (N.C.)
MAKE CONTACT (N.O.)
M.L.R RELAY COIL

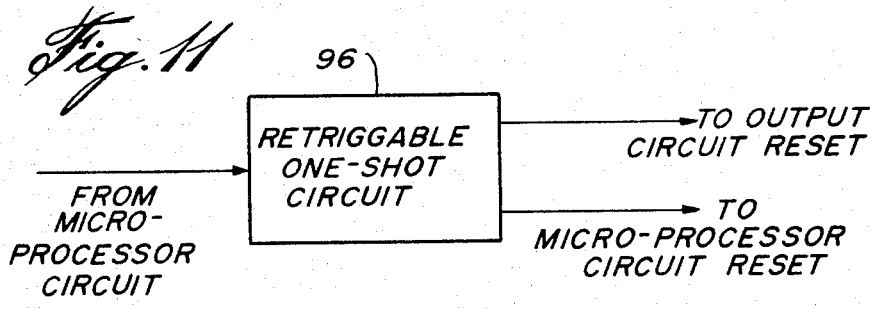
Fig. 11
96
RETRIGGABLE ONE-SHOT CIRCUIT
TO OUTPUT CIRCUIT RESET
FROM MICRO-PROCESSOR CIRCUIT
TO MICRO-PROCESSOR CIRCUIT RESET

RANGE CONTROLLER FOR CONTINUOUSLY MONITORING THE POSITION OF THE BOOM OF HEAVY MACHINERY

FIELD OF INVENTION

This invention relates to a range controller for continuously monitoring the position of the boom of heavy machineries, such as excavators and cranes.

BACKGROUND OF INVENTION

When a contractor has to perform construction, excavation or other types of work on a site, he uses a variety of heavy machinery. Amongst such machinery, some are used for excavation work, other to move loads up and down and from one location to another. These machines are equipped with booms or mobile arms having sometimes a substantial operating range. The mobility and the extent of the displacement of the boom of these machines are important tools for performing the work, but it is also a great danger for the workers and the various obstacles present within the operating range of the machines. Accidents, which are not only materially costly but also cause major injuries to the workers or even loss of lives, often happen. For example, supporting columns are often knocked down by the boom of a crane. When working close to power lines, there is an ever-present danger from the boom to come in contact with the power lines and often cause the death of the operator or other workers on the site. The latter is particularly important due to the increasing number of power lines now found on working sites. In some areas, it is forbidden by law to work within a specific distance from power lines.

Since human error is the main cause of all accidents, various systems have been proposed to detect excessive displacement of the boom of heavy machinery for the purpose of avoiding overloading or striking of obstacles. Applicants of the present application have also disclosed in U.S. Pat. No. 4,236,864 dated Dec. 2, 1980 a "SAFETY CONTROL SYSTEM FOR THE BOOM OF A CRANE". However, the known systems are mostly electro-mechanical in nature and, thus, lack versatility.

OBJECT OF INVENTION

It is therefore the object of the present invention to provide a range controller which uses an electronic control system to continuously monitor the actual position of the boom of heavy machinery with respect to surrounding obstacles and to provide a signal when the boom is approaching any such obstacles and even block the operation of the boom when it is within a critical distance from such obstacle.

SUMMARY OF INVENTION

The range controller in accordance with the invention comprises position sensors mounted on the boom and on the machinery for continuously detecting the position of the boom with respect to a reference; control switches located in the cabin of the machinery for permitting the operator to set the position limits of the boom; a central control circuit mounted on the machinery and comprising a micro-processor circuit adapted for connection to the sensors and to the control switches and memory devices for registering the position of the boom as well as the position limits set by the operator and for continuously comparing the actual position of the boom with the position limits; and indicators located in the cabin of the machinery and responsive to such micro-processor circuit for warning the operator and, block the operation of the boom when a position limit is reached.

The position sensors preferably comprise a vertical position sensor capable of detecting and translating the angle of the boom into an electronic signal readable by the micro-processor circuit, and a horizontal position sensor capable of sensing the relative position of the machine with respect to the horizontal and of translating such position into an electronic signal readable by the micro-processor circuit.

When the machinery is a telescopic crane, a telescopic position sensor may also be positioned on the machinery and adapted to translate the boom length differential position into an electronic signal readable by the micro-processor circuit.

When the machinery is a tower crane, a sensor is provided to detect the position of the trolley travelling on the swinging trolley supporting horizontal boom.

A displacement sensor may also be provided to detect any displacement of the machinery on the ground.

Exterior indicators may also be mounted on the top of the machinery for warning people outside of the cabin of the machinery of the possible danger.

In a preferred embodiment of the invention, the central control circuit comprises an input multi-plexer circuit connected to the position and displacement sensors and to the control switches in the cabin to channel all input data from the sensors and the control switches to the micro-processor circuit, and an output circuit connected to the indicators located in the cabin, to the exterior indicators and to the blocking system to latch output data and drive such indicators and the blocking system following the data provided by the micro-processor circuit.

A failure detector circuit is also preferably provided in the central control circuit for detecting failure of the micro-processor.

Data switches are also preferably provided in the central control circuit and adapted to be programmed at the time of installation of the controller to insert in the micro-processor circuit data that are pertinent to the type of machinery it is adapted to be used on.

BRIEF DESCRIPTION OF THE DRAWINGS

The invention will now be disclosed, by way of example, with reference to the accompanying drawings, in which:

FIG. 10 is a schematic diagram of the output circuit of the central control circuit; and FIG. 11 is a schematic diagram of the failure detector.

DETAILED DESCRIPTION OF INVENTION

Figure 1:
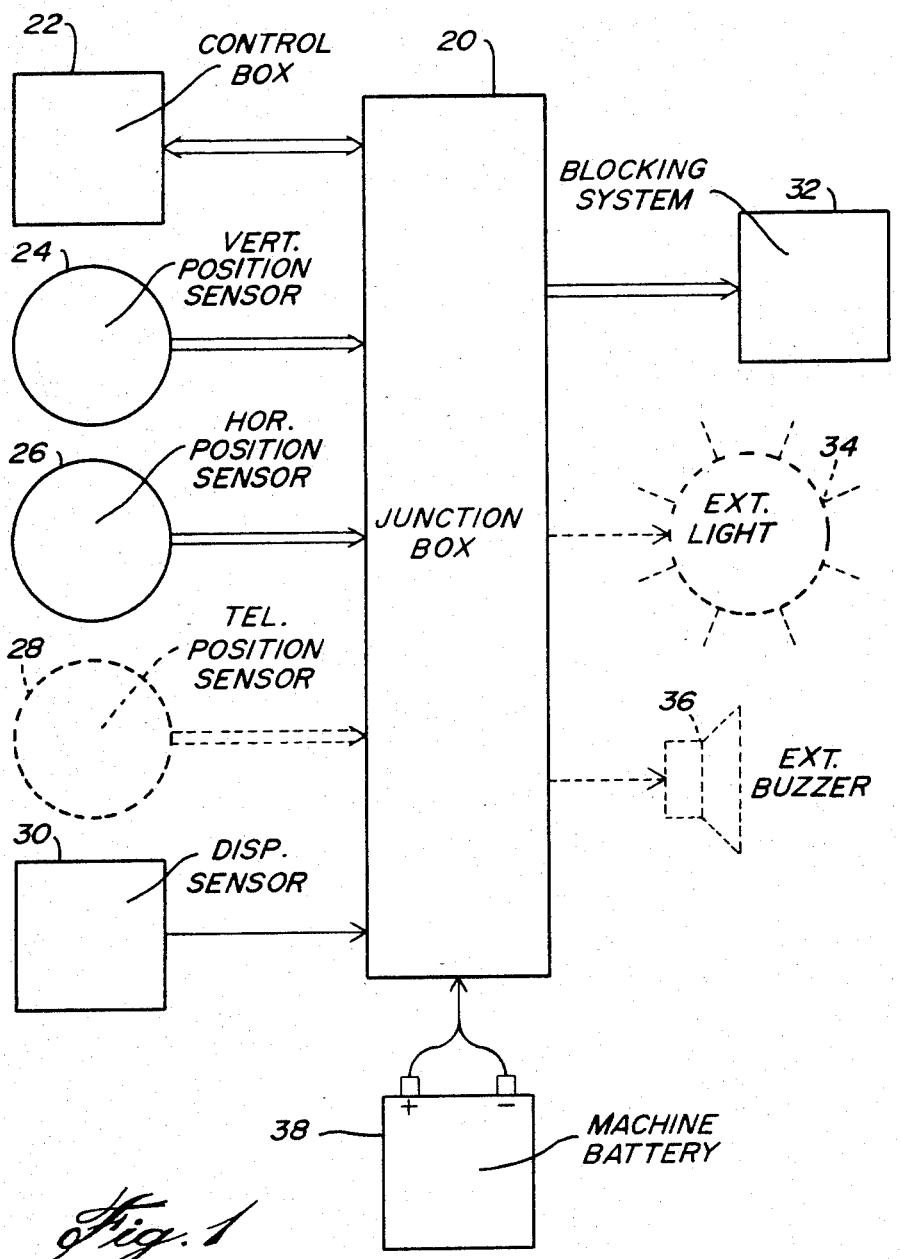
FIG. 1 is a block diagram of a range controller in accordance with the invention.
Figure 2:
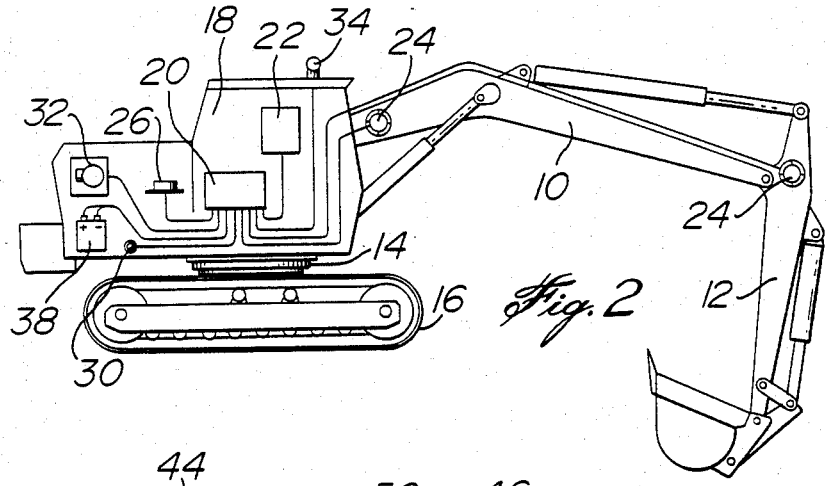
FIG. 2 illustrates schematically the various elements of the block diagram of FIG. 1 installed on an excavator.

FIG. 1 of the drawings illustrates a general block diagram of a range controller in accordance with the invention, while FIG. 2 illustrates the location of the various components of the controller on a conventional excavator, as a simple example of an embodiment of the invention. The excavator is equipped with a main boom 10 which pivots in elevation on the frame of the excavator and heel boom 12, which is articulated on the outer end of the main boom. The boom of the excavator also swings horizontally on a turn-table 14 mounted on a tractor unit 16. A cabin 18 is mounted on the frame of the excavator.

The range controller comprises a junction box 20 including a micro-processor based control circuit, which is mounted inside the cabin 18 at a suitable location, preferably at the back of the operator seat. A control box 22, including indicators and control switches, as it will be disclosed later, is connected to the junction box and installed in the cabin within reach of the operator. A vertical position sensor 24 is installed on the main boom 10 and on the heel boom 12 of the machine. A horizontal position sensor 26 is installed on the rotating system of the machine by means of a proper coupling (not shown). Vertical and horizontal position sensors 24 and 26 are devices capable of translating the angle of the boom and the relative horizontal position of the machine, respectively, into electronic signals readable by the control circuit in the junction box 20. A telescopic position sensor 28 may be used on telescopic cranes. Such a sensor would translate the boom length differential position into an electronic signal readable by the control circuit in the junction box 20. Such a sensor would be installed on the boom of the crane. A displacement sensor 30, which may be a pressure switch or a micro-switch, is also connected to the junction box 20. The displacement sensor is used to detect if the machine changes its position on the ground and is installed at the most proper place in the machine traction system.

For a tower crane, horizontal position sensor 26 is installed on the rotating system of the swinging trolley supporting horizontal boom, while sensor 24 is replaced by a sensor detecting the position of the trolley along the boom. All other characteristics of the system remain the same.

The output of sensors 24, 26, 28 and 30 are all connected to the junction box by suitable cable connections. A blocking system 32, which may consist of valves or other mechanical devices, depending on the type of machine, is connected to the output of the junction box. The blocking system is controlled by a set of relays in the junction box. It is installed at a proper place to assure blocking of the manoeuvers of the machine. An exterior indicator, such as light 34, is installed on the top of the chain. An audible alarm, such as buzzer 36 (FIG. 1), can also be installed to warn people outside of the cabin of a possible danger. Power is provided to the junction box by the machine battery 38, or any other suitable source of supply.

Figure 3:
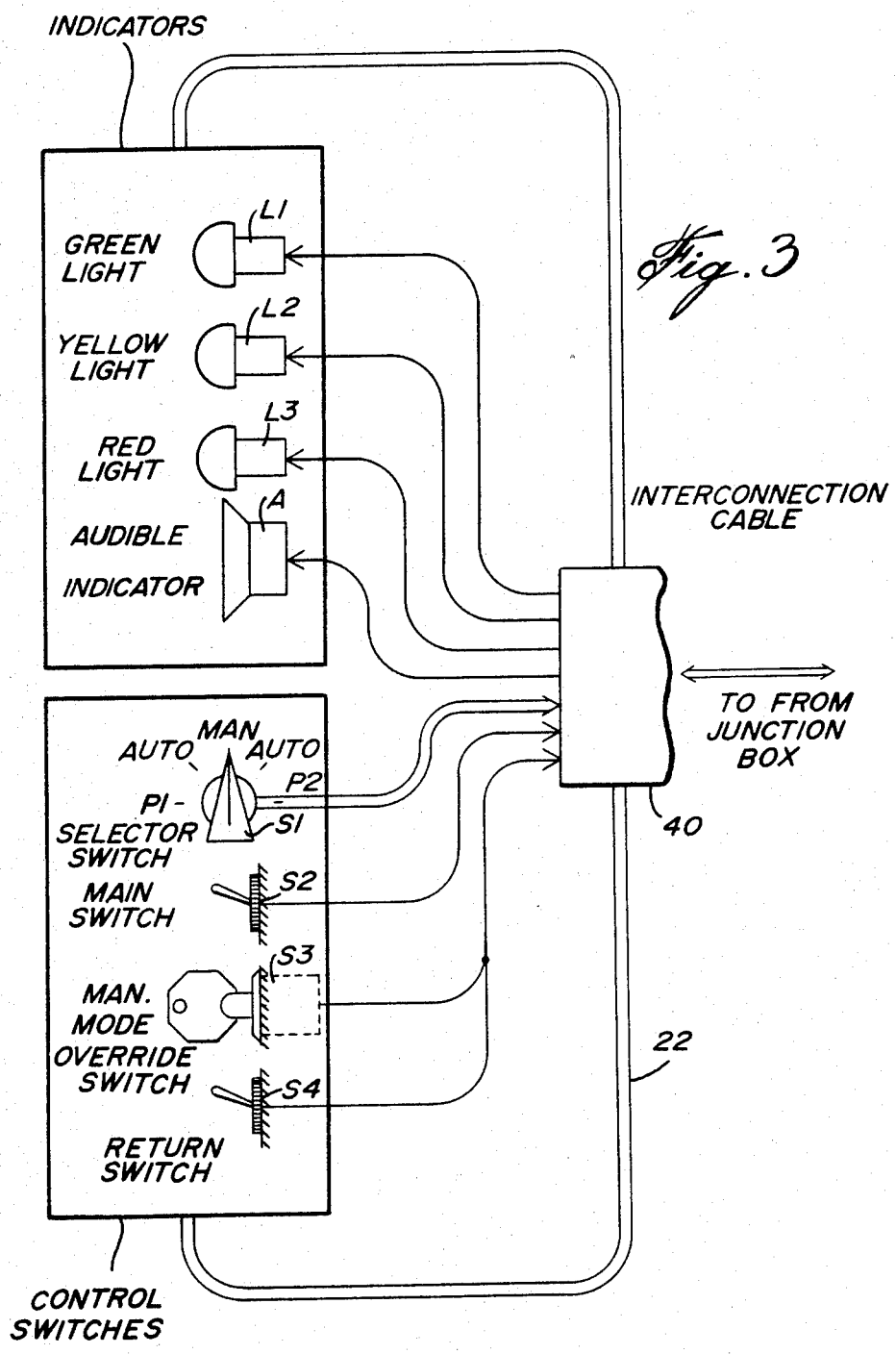
FIG. 3 is a block diagram of the control box.

FIG. 3 is a block diagram of the control box 20, mentioned previously. This box contains the following control switches for the operation of the system:

(a) a selector switch S1, which is used to choose the mode of operation and to program the position limits of the boom, as it will be disclosed later;

(b) a main switch S2, which is used to put the power on;

(c) a manual mode override switch S3, which is used by the foreman, for example to insure that the operator will really use the system and program limits; and (d) a return switch S4, which is used to come back in the work zone when the manoeuvers have been blocked by the blocking system 32.

The control box also contains visual and audible indicators that will inform the operator if the machine is in its work zone (green light L1), its warning zone (yellow light L2 flashing and buzzer A beeping), or its forbidden zone (red light L3 and buzzer A). Also, if failure occurs, the proper indications will warn the operator. All these indicators and switches are wired on a cable 40 for connection to the junction box 20.

Figure 4:
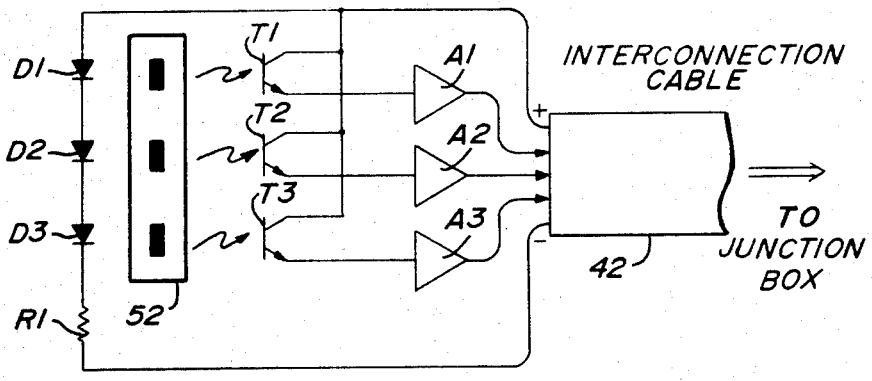
FIG. 4 is a block diagram of a vertical position sensor.

FIG. 4 is a schematic diagram of the vertical position sensor 24. This module is installed on the boom of the machine, in a certain position. It contains a set of light-emitting diodes D1, D2, and D3 facing photo-transistor detectors T1, T2, and T3, respectively. The outputs of the photo-transistor detectors T1, T2, and T3 are then amplified by amplifiers A1, A2, and A3, respectively, before being fed to the junction box as an input to cable 42. The diodes are energized from the battery supply of the junction box through resistor R1.

Figure 5:
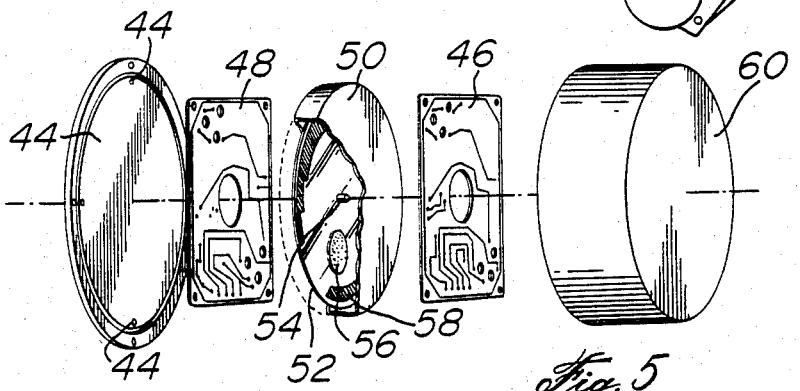
FIG. 5 illustrates an embodiment of a position sensor in accordance with the invention.

A structural embodiment of a detector unit is shown in FIG. 5 of the drawings. The embodiment comprises a base plate 44, which is secured to the boom of the excavator. Diodes D1, D2, and D3 are mounted on circuit board 46 and photo-transistor detectors T1, T2, and T3 are mounted on circuit board 48. Mounted between the two circuit boards 46 and 48 is a transparent casing 50 into which is mounted a plate 52 which is adapted to rotate freely on a central axle 54. One-half of the plate 52 is made heavier than the other by the addition of a weight 56, so that the plate will always stay in the same position with regard to the horizontal. However, the circuit boards 46 and 48 are fixed to the base plate 44, so that there is relative movement between the optic couplers (D1-T1, D2-T2, etc.) and the plate 52 when the boom of the machine is moved with respect to the vertical. A coded screen, illustrated schematically by reference numeral 58, is placed on the plate 52. In a preferred embodiment of the invention, this coded screen has three rows of opaque and transparent spots that will interfere with the path of the light between the light-emitting diodes D1, D2 or D3 and the photo-transistors T1, T2 or T3, respectively, so that the photo-transistors will give output signals that can be translated into the angle of the boom with respect to the horizontal. Of course, any type of coding system capable of translating the angle of the boom into an electronic signal readable by the micro-processor, can be used. The casing 50 is preferably filled with oil to allow dampening of the plate 52 during movement of the boom. A cover 60 is provided for enclosing the horizontal sensor.

Figure 7:
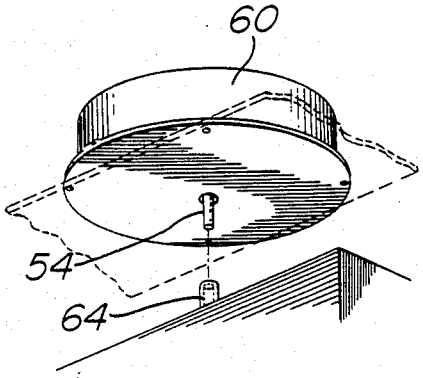
FIG. 7 illustrates an embodiment of a horizontal position sensor in accordance with the invention.
Figure 6:
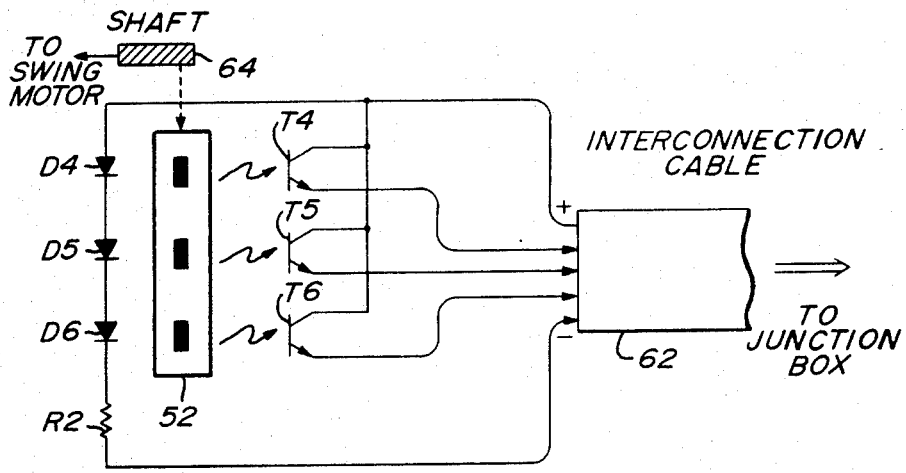
FIG. 6 is a block diagram of a horizontal position sensor.

FIG. 6 is a circuit diagram of the horizontal position sensor 26. This module contains a set of light-emitting diodes D4, D5, and D6 facing photo-transistor detectors T4, T5, and T6, respectively. The output of the photo-transistor detectors is fed to the junction box as an input through cable 62. The diodes are energized from the battery supply of the junction box through resistor 82. The construction of the horizontal sensor is the same as the vertical sensor, shown in FIG. 5, except that the plate 52 has no weight and that the axle 54 of plate 52 is coupled to the shaft 64 of the machine swing motor, as shown in FIG. 7.

A coded screen is also put on the rotating plate 52, as for the vertical sensors; this will interfere in the light path of the optic couplers to generate at the output of the photo-transistors a a signal that can be translated into the horizontal position of the machine with respect to a reference.

The telescopic position sensor may be identical to the horizontal position sensor. However, instead of being coupled to the swing motor, the shaft is coupled to a winch that will rotate when the length of the boom changes.

Figure 8:
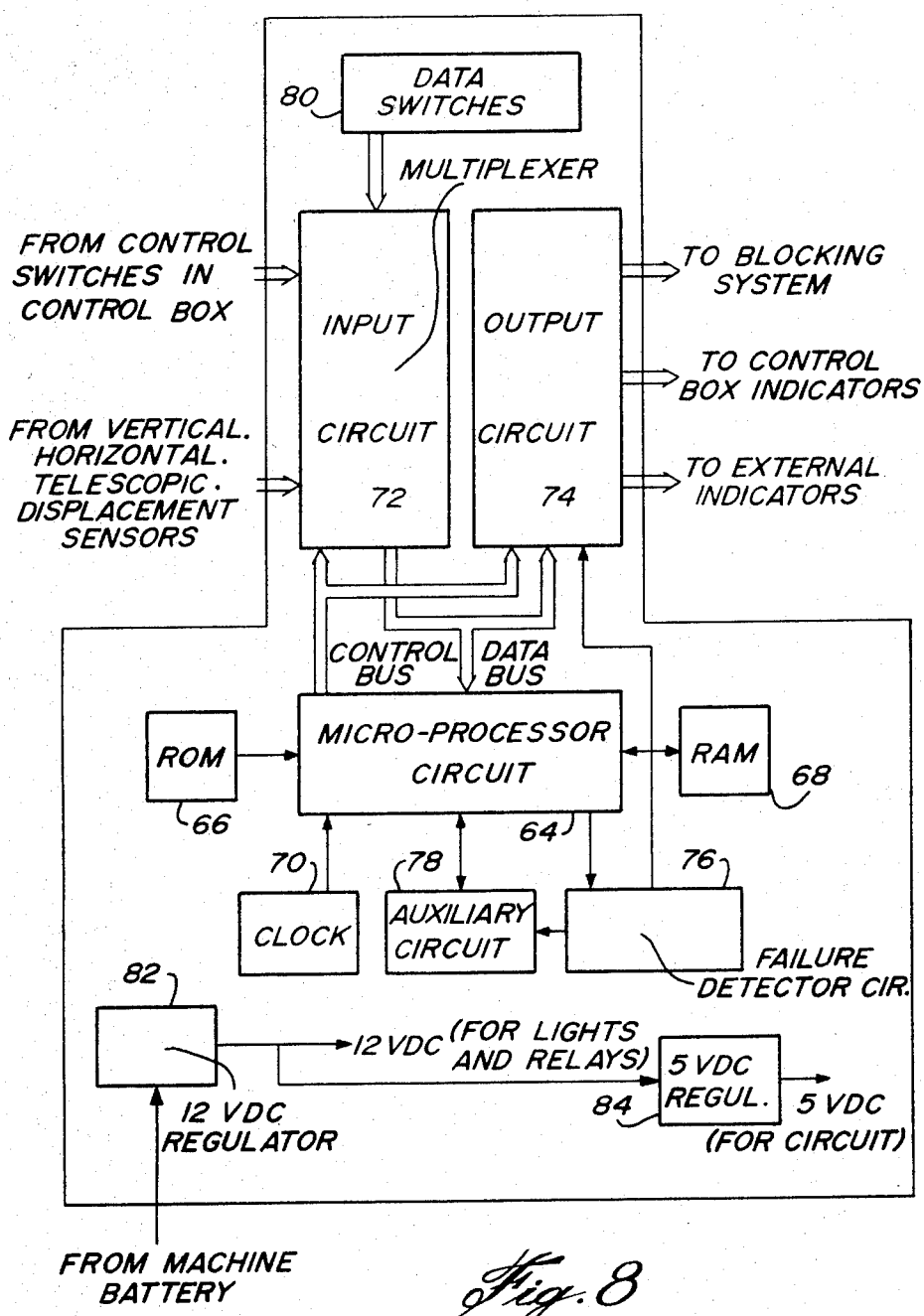
FIG. 8 is a schematic diagram of the central control circuit.

FIG. 8 is a block diagram of the junction box. It contains the central control circuit and all the necessary components to connect to all the modules of the controller. As this control circuit is micro-processor-based, almost all the functions of the control circuit are executed by the software and these functions will be analyzed later in the software description.

The control circuit is made of the following interrelated circuits:

(a) a micro-processor circuit 65 which controls everything. The program (software) is stored in a read-only-memory (ROM) 66 containing all the instructions that will be executed sequentially by the micro-processor circuit, as it is commonly known in the art. A random access memory (RAM) 68 is connected to the micro-processor circuit to store data and for intermediate calculations, as also commonly known in the art. The operation of the micro-processor is synchronized by a clock 70;

(b) an input multi-plexer circuit 72, which is used to control all input data from the control switches in the control box 22 and from the sensors 24, 26, 28, and 30 to the micro-processor circuit. The input multi-plexer is controlled by the micro-processor circuit. A more detailed description of the input multi-plexer circuit will follow;

(c) an output circuit 74, which is used to latch output data and drive the blocking system 32, the control box indicators and the external indicators 34 and 36, following the data provided by the micro-processor circuit. The output circuit is also controlled by the micro-processor. A more detailed description of the output circuit will follow;

(d) a failure detector circuit 76, which is used to detect a failure of the micro-processor. A more detailed description of the failure detector circuit will follow;

(e) an auxiliary circuit 78, which provides the necessary reset circuit to initiate the operation of the micro-processor. The auxiliary circuit also contains an astable circuit to make the control box indicators flash under the control of the micro-processor circuit.

Data switches 80 are also connected to the input multi-plexer circuit 72. These switches are important to assure system versatility. Before installation, the system may be used on any kind of machine, such as excavators and conventional telescopic or tower cranes. But these machines all have special characteristics that must be known by the control circuit to assure proper operation. These switches are then programmed at the time of installation to insert in the system data that are pertinent to the type of machine it is to be adapted to. The nature of these data will be discussed in the software description.

A 12 V.D.C. power supply is required for energizing the indicators and relays of the system. This may be provided directly from the battery of the machine when such battery is 12 V.D.C. However, when the battery of the machine is a 24 V.D.C., a regulator 82 is connected to such 24 V.D.C. battery for providing the required 12 V.D.C. A 5 V.D.C. regulator 84 is connected to the output of the regulator 82 or to the output of the 12 V.D.C. battery of the machine for providing suitable voltage for the operation of the micro-processor circuit.

Figure 9:
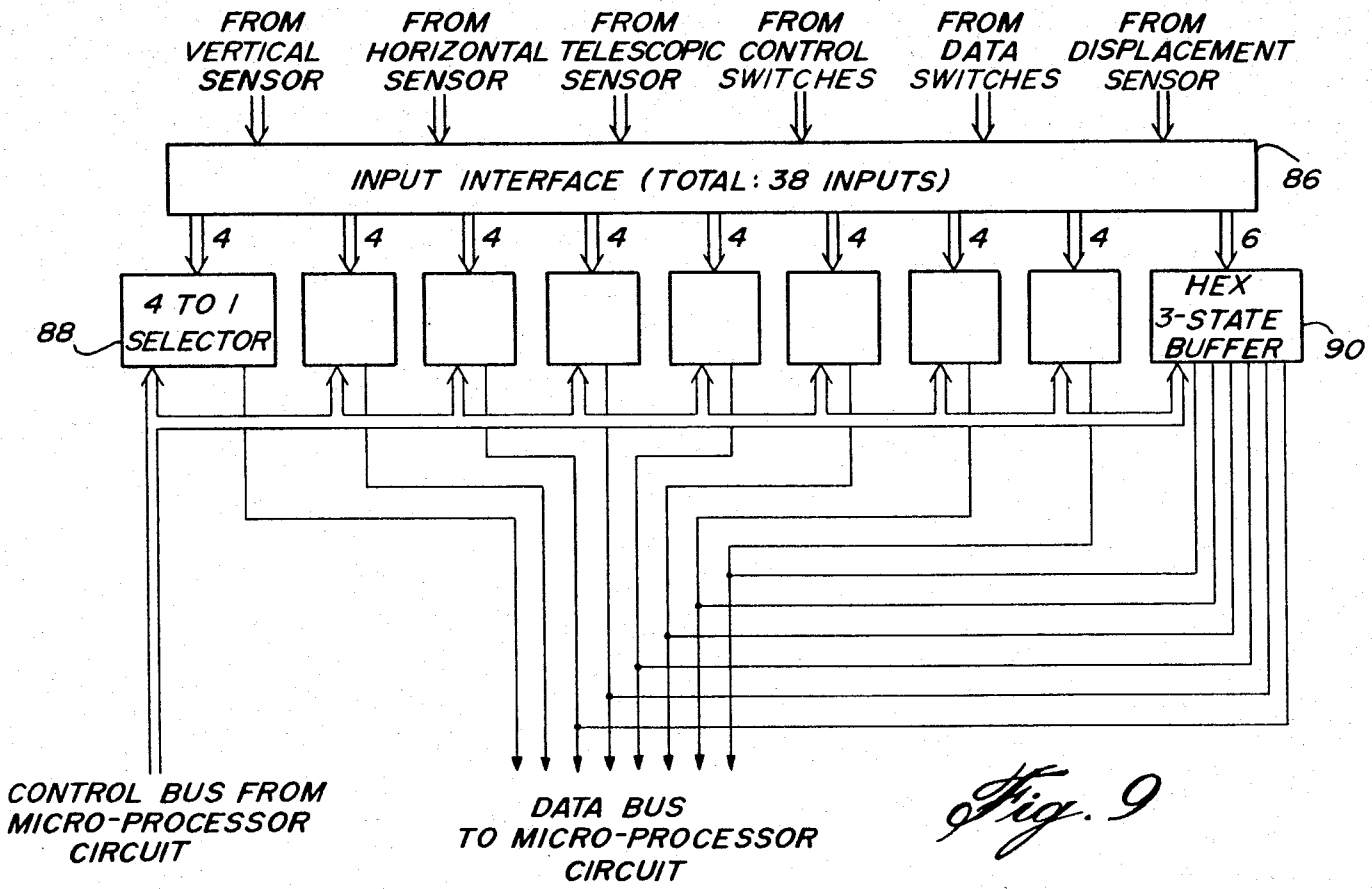
FIG. 9 is a schematic diagram of the input multiplexer of the central control circuit.

FIG. 9 is a schematic diagram of the input multiplexer circuit. It has two stages. The first is an input interface 86, consisting of well-known circuits, adapted to reshape the input signals from the various sensors and control and data switches to make them compatible with the micro-processor circuit. The input signals are separated in groups of four by the input interface 86 and fed to a set of eight 4 to 1 channel selectors 88. For each group of four, only one input signal at a time is connected to the data bus going to the micro-processor circuit. The selection is made via the control bus from the micro-processor circuit. Thus, the micro-processor can "read" four 8-bit data words (32 input signals). A fifth word of 6 bits can be read via six three-state buffers (HEX 3-state buffer 90) connected on the data bus.

FIG. 10 is a schematic diagram of the output circuit. The data bus from the micro-processor circuit is connected to eight well-known latches 92 acting like small memories. Under control of the control bus of the micro-processor circuit, the latches will store the proper output signals. These signals are then buffered by well-known output amplifiers 94 to drive the control box and external indicators and a set of relays M,L and R. A special feature of the relay output is that there is an interlocking circuit on both the coils and the contacts. This is to avoid two or three contacts to be actuated at the same time, a situation that must not occur for safe operation but could occur if a failure happens.

Relays M,L and R are used to operate the blocking system. For most applications, only the M (main) relay is used. It operates either a main valve or an electro-mechanical device, depending on the type of machine, in order to allow the operator to manoeuver the machine. As a matter of fact, the system is wired in such manner that the relay M and the hydraulic, pneumatic or electro-mechanical component actuated by it must be operated, or "alive", to enable the operation of the machine. This is an important safety feature; if there is a power failure, or break in a wire, etc., the relay M is released and the manoeuvers are blocked.

Also, a certain number of machines are "free swing", which means that, when the main valve is released to block the machine controls, there is no sufficient break on the swing motor to stop rotation of the machine, which is a very unsafe situation. The machine can continue to swing and hit an obstacle.

The purpose of L (left) and R (right) relays is to force the rotation in the opposite direction up to the point when the machine is stopped. This matter will be discussed further in the software description.

Concerning the blocking system, it is important to note that on most hydraulic machines, it is possible to block the manoeuvers by introducing a small valve (or set of valves) in the hydraulic system which assists the power system, instead of using a large valve in the power system. This allows a simpler and much less expensive installation.

FIG. 11 is a schematic diagram of the failure detector. The principle of operation of the micro-processor consists in executing a set of instructions in sequence (the program). When the program loop is executed, the processor gets back to the first instruction and executes the same loop again, and so on. Each loop takes a certain time of execution, in the order of a few milliseconds. Thus, the program loop contains the necessary instructions to generate a pulse at a certain output and, during normal operation, this output will generate a continuous pulse train. As shown in FIG. 11, this pulse train is used to trigger and re-trigger a one-shot circuit 96 to maintain its output in a certain state. In this manner, if something goes wrong in the micro-processor circuit, the pulse train will stop and the one-shot circuit will fall in the failure state. This will reset the output circuit 74 and cause the main relay M to release and block the manoeuvers. Also, the micro-processor circuit will be reset in an attempt to start again the program loop.

The above-disclosed hardware is controlled by the program stored in the read-only-memory (ROM) 66. The program, or software, is the set of instructions which enables the micro-processor circuit 64 to achieve all the functions that are necessary for the good operation of the system. These functions are as follows:

(a) Input reading

The input reading routine controls the input multiplexer 72 to reach all the input information coming from the sensors 24, 26, 28, and 30, the control switches in control box 22 and the data switches 80. The input information is then stored in the RAM 68 for further use.

(b) Option selection

This routine will take the data on some of the data switches 80 to determine whether the system is used on an excavator, a conventional crane, a telescopic crane or a tower crane. The option data will be used further to make branches at the proper routines or to interpret the data in the proper manner, because some differences among the machines will involve differences in the data treatment.

(c) Limit selection

Depending on the type of machine and the mode of operation, the type of limit to be stored in the RAM memory 68 will vary. This routine uses the option data and the selector switch S1 in the control box 22 to select the proper branches and data treatment to be done. In this manner, it is possible to use the system in almost any situation in the field.

(d) Limit recording

After the limit selection has been made, the limits are automatically recorded. The limits will essentially be the maximum position data received from each sensor 24, 26 or 28, or a combination of them. For example, the maximum vertical position of the boom can be recorded alone. Or on a telescopic crane, a combination of the boom angle and the boom length allows the calculation of the limit position of the boom cable. This will be further discussed in this chapter.

(e) Buffer zone calculation

When the limit data are stored in the RAM memory 68, a calculation is made to determine the limits of a certain buffer zone which is used to warn the operator of the approach of a limit in order to allow him to react accordingly. The width of the buffer zone can be programmed during installation, by means of the data switches 80, and thus can have different values, depending on the application.

(f) Current position calculation

The current position of the machine is, of course, continuously calculated from the input data coming from the sensors 24, 26, and 28. The signals come in pulses or pulse trains and must be interpreted with regard to a reference determined by the processor. The signals are first analysed to detect a false condition, which would result from a defective component. Then a set of counters stored in the RAM 68 are incremented or decremented, depending on the direction of the movement. The state of these counters is the current position of the machine.

(g) Telescopic boom length compensation

On a telescopic crane, the current position is not determined only by the angle of the boom but also by its length, which may vary during operation. So the current position calculation must take into account the angle of the boom with regard to the horizontal, the initial boom length and the boom length increases. For a "wall" position (to be defined later), the formula is the following:

$$P=(L+1)\cos A$$

where:

P=position of the boom

L=initial boom length

1=boom length increase

A=boom angle relative to the horizontal

A is in degrees, P, L and 1 have the same arbitrary unit, the most convenient that has been found to simplify the design of the system. The value of L is determined during installation, via the data switches.

For a "ceiling" position (to be defined later), the formula is:

$$P=(L+1)\cos(90-A)$$

As it will be described later, the operator can program the system for "wall" or "ceiling" limits, depending on the position of the obstacles.

When programming the limits, it is thus the maximum value of P that is stored as the limit. And when the comparison is made between the current position and the limit, the boom length/boom angle compensation is automatically made: for a "wall" limit, if A increases, 1 can increase before reaching the same P limit. For a "ceiling" limit, if A increases 1 must decrease to stay in the limit.

(h) Zone calulation

Once the position limits, and the buffer zone limits are known, the range of the machine can be divided into three zones: a working zone, a buffer zone and a forbidden zone. By comparison of the current position with the prerecorded limits, it becomes easy to determine in which zone the machine stands.

(i) Swung speed calculation

As mentioned in the hardware description, it may be necessary to use the L or R relays to stop the rotation of the machine. In order to get a smooth operation, it becomes necessary to know the swing speed of the machine. Thus the L or R relay will be operated only if the swung speed is greater than a certain preset value. This value may be programmed on some of the data switches 80. Also, if the L or R relay is operated, it will release automatically when the swing speed drops under the preset value.

This routine calculates the swing speed by counting the input pulses coming from the horizontal position sensor 26 in a certain speed of time.

(j) Output setting

The output routine takes the results of the calculations and sets the state of the outputs following the zone and the position of the selector switch S 1. When the output signal is properly set, it is directed on the data bus to the latches 92 in the output circuit 74 via the control bus. This will operate the indicators L1, L2, L3 and A of the control box 22, the external indicators 34 and 36, and the blocking system 32 via the output relays M, L and R.

(k) Fail-safe feature

As the system is a safety device, it must react safely when it is defective. For this reason, the system hardware is designed so that the input data is coded before being "read" by the micro-processor circuit 65. In this manner, if a component fails, either in a sensor 24, 26 or 28 or in the junction box 20 or the control switches S1, S2, S3 and S4, it will induce a wrong code that will be detected by the software. As a result, the program will block the manoeuvres and give an indication of failure to the operator.

The program also generates a pulse train that can be detected by the failure detector circuit. If something goes wrong in the micro-processor circuit, the program will no more be executed and the pulse train will stop. This will also block the manoeuvres (see the hardware description of FIG. 11).

(l) Machine displacement

When the machine moves on the ground, a signal is given by the displacement sensor. This signal is used to modify the limits that could vary with regard to the position of the machine on the ground. The limits are not corrected but modified in such a manner that the operator will stay in a secure situation.

The range controller can be operated following different modes, depending on the situation of the machine with regard to the surrounding obstacles. In fact, the system acts in such a manner that in some instances a virtual "ceiling" is simulated over the machine and the controls of the machine are blocked when the boom reaches a certain angle sensed by the vertical position sensor 24, no matter the horizontal position. In other instances, it is a "wall" that is simulated in the same manner, in front of the machine.

On the other hand, "side-walls" may be simulated by using the horizontal position sensor 26, so that the swing motor of the machine will stop at certain horizontal positions.

The purpose of the range controller is to place these "ceiling", "wall" or "side-walls", or a combination of them, between the obstacle (s) and the machine. The different modes are:

(a) Mode 1

Such mode is used to program a "ceiling" limit only. With the selector switch S1 on P1, the operator moves the boom upward, up to the acceptable limit, before coming back in the working zone. Result: a ceiling limit is sensed by vertical position sensor 24 over 360° of rotation. Such ceiling limit is stored in the RAM memory 68.

(b) Mode 2

Such mode is used to program "side-wall" limits only. With the selector switch on P1, the operator rotates the machine up to the acceptable left and right limits, before coming back in the working zone. Result: no ceiling limit in the opening but "side wall" limits on both sides allowing no access outside such limits. Such "side wall" limits are likewise stored in the RAM memory 68.

(c) Mode 3

Such mode is used to program a "ceiling" limit with an opening. with the selector switch on P1, the operator moves the boom upward and rotates the machine left and right up to the acceptable limits, before coming back in the working zone. Result: no ceiling limit in the opening and a ceiling limit outside the opening.

(d) Mode 4

Such mode is used to program a variable "ceiling" limit over a certain angle of rotation. With the selector switch on P2, the operator rotates the machine while maintaining the boom always at its limit, whatever, the limit, which may vary in whatever manner over up to 360° of rotation. Result: a ceiling limit that will vary with regard to the horizontal position of the machine. If the operator does not cover 360° of rotation, there will be no access in the remaining portion of the range.

(e) Modes using a "wall" limit

When using the preceding modes, a "ceiling" limit is programmed because the processor stores the most "upward" value reached by the vertical position sensor. However, when the system is used on a crane for example, it is often the most "downward" value that must be stored as the limit, as the wire of the crane may touch an obstacle placed in front of it. This means that the limit becomes a "wall" limit. It is possible for the operator to select the "ceiling" or "wall" operation by means of a switch.

In the case where operator selects the "wall" operation, he can use mode 1, mode 2, mode 3 or mode 4 in the same manner as previously described, but with a "wall" instead of a "ceiling" and move the boom downward instead of upward.

(f) Manual mode

This mode is used to work without any limit. As mentioned earlier in the hardware description, the blocking system components must be "alive" to enable the operation of the machine, which means that the system must be "on". Thus, when no limit is required, the manual mode can be used. The selector switch S1 is on MAM.

(g) Manual mode cancellation

When a job asks for a high level of security, it is possible for the foreman to be sure the operator will use the system and program it with limits. To do this he just has to operate a key switch S3 provided with the system, and remove the key. This switch cancels the maual mode, which means that the machine cannot be operated unless limits are programmed.

(h) Return to the working zone

When the operator reaches a limit, all the manoeuvres are blocked. In order to come back in the working zone, the operator can put the selector switch on MAN or use the return switch S4. This return switch gives back the controls to the operator for the time he operates it.

The visual lights L1, L2 and L3 and the audible indicator A give the operator all the necessary information concerning the mode of operation and the current zone (working, buffer or forbidden). They also indicate if a failure has been detected.

In order to implement the functions which were described in the hardware description, it is possible to use many types of circuits and components. Those that have been selected are all simple, standard and known circuits and components so that there is no need be describe them in further detail.

Also, all the components that could be inappropriately affected by the environment are preferably protected by, for example, solid metal boxes, shields, sealing compound, heat sinks, insulating materials, and so on.

What we claim is:

1. A range controller for continuously monitoring the position of the boom of heavy machinery, comprising:

(a) position sensors mounted on the boom and on the machinery for continuously detecting the position of the boom with respect to a reference;

(b) control switches located in the cabin of the machinery for permitting the operator to set the position limits of the boom;

(c) a central control circuit mounted on the machinery and comprising a micro-processor circuit adapted for connection to the sensors and to the control switches and two memory devices connected to said micro-processor circuit for registering the position of the boom as well as the position limits set by the operator and for continuously comparing the actual position of the boom with the position limits;

(d) indicators located in the cabin of the machinery and responsive to said micro-processor circuit for warning the operator when a position limit is reached;

(e) a blocking system responsive to the micro-processor for blocking the operation of the boom when a position limit is reached;

(f) a main relay for operating said blocking system, said main relay being electrically energized during normal operation of the machine to release the blocking system so that, if there is a power failure, or a break in a wire, etc., the main relay is released to operate the blocking system; and (g) additional relays for reversing the operation of the boom when the main relay is released so as to ensure safe stopping of the boom.

2. A range controller as defined in claim 1, further including a control system and a main power system, and wherein said relays are located in said control system which assists the main power system.

3. A range controller as defined in claim 1, wherein the position sensors comprise a vertical position sensor capable of detecting and translating the angle of the boom into an electronic signal readable by the micro-processor circuit, and a horizontal position sensor capable of sensing the relative position of the machine with respect to the horizontal and of translating such position into an electronic signal readable by the micro-processor circuit, said vertical and horizontal position sensors permitting the micro-processor circuit to make a correlation of the vertical and horizontal movements of the boom in a two-dimensional plane with respect to said reference to register the limit and current position of the boom, said boom being of the telescopic type and further including a telescopic position sensor capable of detecting and translating the boom length differential position into an electronic signal readable by the micro-processor circuit, and further including a displacement sensor to detect any displacement of the machinery on the ground.

4. A range controller as defined in claim 3, further comprising exterior indicators mounted on the top of the machinery for warning people outside of the cabin of the machinery of a possible danger.

5. A range controller as defined in claim 4, wherein said control circuit further comprises an input multiplexer circuit connected to the position and displacement sensors and to the control switches to channel all input data from the sensors and the control switches to the micro-processor circuit, and an output circuit connected to the indicators located in the cabin, to the exterior indicators and to the blocking system to latch output data and drive the indicators and the blocking system following the data provided by the micro-processor circuit.

6. A range controller as defined in claim 5, wherein all input data fed to the micro-processor is coded, and further comprising a failure detector circuit for detecting an erroneous code or a failure of the micro-processor circuit.

7. A range controller as defined in claim 5, further comprising data switches connected to the input multiplexer circuit and which are programmed at the time of installation of the controller to insert in the micro-processor circuit data that are pertinent to the type of machinery it is to be adapted to be used on.

8. A range controller as defined in claim 7, wherein said data switches allow the micro-processor circuit to determine the limits of a certain buffer zone from the position limits set by the operator, and wherein said indicators include means to warn the operator of the approach of a limit in order to allow him to react accordingly.

* * * * *